US005370833A

United States Patent [19]

Wellenhofer et al.

[11] Patent Number: 5,370,833

[45] Date of Patent: Dec. 6, 1994

[54] PROCESS OF MAKING FIBERS WHICH GIVE OFF TROUBLESOME GASES AND/OR VAPORS DURING SPINNING

[75] Inventors: Herbert Wellenhofer, Strassberg; Gerhard Leumer, Bobingen; Andreas Fischer, Frankfurt am Main; Diethelm Rabe, Berlin; Hans-Jürgen Profé, Bobingen, all of Germany

[73] Assignee: Hoechst Aktiengesellschaft, Germany

[21] Appl. No.: 97,121

[22] Filed: Jul. 26, 1993

[30] Foreign Application Priority Data

Jul. 25, 1992 [DE] Germany ..... 4224707

[51] Int. Cl.[5] ..... B01D 53/04; D01D 1/10; D01D 5/092

[52] U.S. Cl. ..... 264/101; 95/131; 95/132; 95/135; 95/136; 95/137; 95/141; 95/142; 264/169; 264/211.14

[58] Field of Search ..... 264/37, 101, 169, 176.1, 264/211.14; 95/131, 132, 135, 136, 137, 141, 142

[56] References Cited

U.S. PATENT DOCUMENTS

| | | | |
|---|---|---|---|
| 2,886,848 | 5/1959 | Henry . | |
| 3,135,811 | 6/1964 | Barnett . | |
| 4,702,871 | 10/1987 | Hasegawa et al. | 264/101 |
| 4,780,073 | 10/1988 | Katsumi et al. | 425/72.2 |

FOREIGN PATENT DOCUMENTS

| | | | |
|---|---|---|---|
| 143173 | 6/1985 | European Pat. Off. . | |
| 2078459 | 5/1971 | France . | |
| 1278684 | 5/1969 | Germany . | |
| 179874 | 2/1966 | U.S.S.R. | 264/211.14 |

OTHER PUBLICATIONS

Abstract of Japan 52-155,216 published Dec. 23, 1977.
Abstract of U.S.S.R. 998,605 published Feb. 23, 1983.
Abstract of Japan 55-137,207 published Oct. 25, 1980.

*Primary Examiner*—Leo B. Tentoni
*Attorney, Agent, or Firm*—Connolly & Hutz

[57] ABSTRACT

A process produces fibers from polymers which give off troublesome gases and/or vapors during spinning, comprising the steps of:

a) extruding the molten polymer through a spinneret into a closed spinning shaft,
b) quenching the resulting filaments in the spinning shaft with a gas,
c) taking off the resulting filaments from the spinning shaft,
d) conducting the quench gas away from the spinning shaft and introducing it into a gas purification system and
e) purifying the used quench gas by contact with an adsorbent for said troublesome gases and/or vapors.

It is possible by the present invention to keep hazardous gases occurring during the spinning of polymers away from the surroundings and to dispose of them. Suitable polymers are in particular polyphenylene sulfides.

17 Claims, 1 Drawing Sheet

Figure 1:
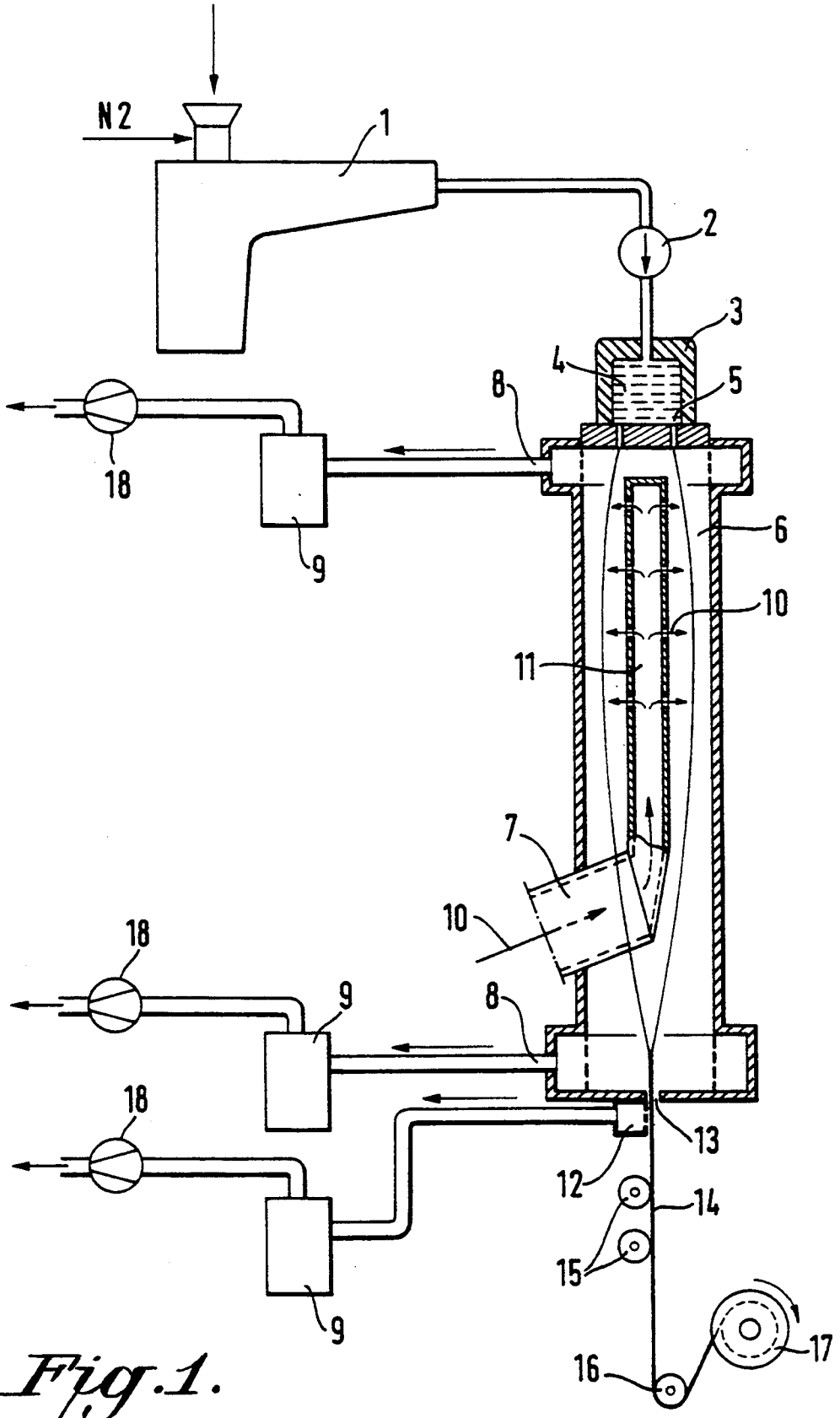

PROCESS OF MAKING FIBERS WHICH GIVE OFF TROUBLESOME GASES AND/OR VAPORS DURING SPINNING

Process and apparatus for producing fibers which give off troublesome gases and/or vapors during spinning.

The present invention relates to a novel process for producing fibers which give off troublesome gases and/or vapors during spinning, in particular fibers based on polyarylene sulfides, and an apparatus adapted therefor.

Melt-spinning processes of thermoplastic polymers, in which encapsulated spinning shafts are used, are known per se.

Thus, in EP-A-143,173, a melt-spinning process of thermoplastic polymers is described in which the polymer is extruded into a spinning shaft which is under superatmospheric pressure and is cooled within this shaft. In addition, an adapted apparatus is described for carrying out the process, which apparatus is provided with a specially configured outlet orifice for the solidified filaments which are taken off at high speed and by which good sealing of the spinning shaft can be achieved. The apparatus and the process are intended especially for the production of a highly oriented multifilament yarn.

In EP-A-205,694, a melt-spinning process of thermoplastic polymers is described, in which the polymer is extruded into a spinning shaft which is at a reduced pressure of less than 0.7 atm and is cooled within this shaft. The apparatus for carrying out this process relates essentially to the apparatus disclosed by EP-A-143,173, at the outlet side of which a vacuum pump is connected for the gas situated within the spinning shaft. In the description it is mentioned that monomers and oligomers evaporating from the spun filaments are removed from the spinning shaft by the gas conduction, so that problems with residues depositing in the spinning shaft can be avoided. The apparatus and the process are likewise intended for the production of a highly oriented multi-filament yarn.

In the melt-spinning of polymers, troublesome gases and/or vapors are frequently liberated. In particular, when polymers containing sulfur-containing constituents are spun, strongly smelling and possibly even toxic gases or vapors are released. This problem is particularly pronounced when multifilaments are spun, since, as a consequence of the high surface area of the molten-liquid capillaries, they release large amounts of such hazardous gases.

The object of the present invention is to keep troublesome gases, which are produced during the spinning of polymers, away from the surroundings and to dispose of them.

This object is achieved by spinning such polymers into a closed spinning shaft, quenching the filaments formed and by subsequent special purification of the quench air conducted out of the shaft.

The present invention relates to a process for producing fibers from polymers which give off troublesome gases and/or vapors during spinning, comprising the steps of:

a) extruding the molten polymer through a spinneret into a closed spinning shaft,
b) quenching the resulting filaments in the spinning shaft with a gas, c) taking off the resulting filaments from the spinning shaft,
d) conducting the quench gas away from the spinning shaft and introducing it into a gas purification system and
e) purifying the used quench gas by contact with an adsorbent for said troublesome gases and/or vapors.

The term "fibers from polymers which release troublesome gases and/or vapors during spinning" in the context of this invention is taken to mean those fibers from which, during melt-spinning, gases and/or vapors are released in the spinning shaft, the escape of which into the surrounding air is not desired. These include, for example, the so-called "spinning fumes" and in particular gaseous and/or vaporous constituents which contain sulfur-containing or halogen-containing, in particular chlorine-containing, or sulfur- and halogen-containing components. The polymers which give off these latter gaseous and/or vaporous constituents include sulfur-containing polymers, such as polyarylene sulfides or polymers which are provided with halogen- and/or sulfur-containing additives before or during spinning.

The process according to the invention is preferably used in the spinning of polyarylene sulfides or in the spinning of mixtures containing polyarylene sulfides and other thermoplastic polymers. Polyarylene sulfides which can be used in the process according to the invention are all filament-forming polymers which principally have the repeating structural unit of the formula I —At—S—(I), in which Ar is a divalent mononuclear or polynuclear aromatic radical whose free valencies are in the p-position or m-position or in a parallel or angled position to each other comparable to these positions. The polymers can also be partially crosslinked structures if these can be spun under the above-defined spinning conditions.

Mixtures of polyarylene sulfide polymers can also be used, or polyarylene sulfide polymers which have different repeating structural units of the formula I in one molecule. Examples of mixtures of polyarylene sulfides are listed in EP-A-407,887, whose contents are also a subject matter of the present description.

Examples of thermoplastics which can be used in a mixture with polyarylene sulfides are polyesters, such as polyethylene terephthalate; poly-α-olefins, such as polyethylene or polypropylene; partially fluorinated or perfluorinated polymers, such as polytetrafluoroethylene; or a polyether ketone adapted to the melting characteristics of the polyarylene sulfide.

The polyarylene sulfides used are preferably polyphenylene sulfides, in particular polymers in which Ar is a p-phenylene radical.

Preferred polyphenylene sulfides have, at 320° C., a melt viscosity, measured at a shear rate of 1000 $sec^{-1}$ ($\eta_{1000}$), of 60 to 150 Pa*s and a melt viscosity, measured at a shear rate of 3000 $sec^{-1}$ ($\eta_{3000}$), of more than 50 Pa*s, in which the difference between $\eta_{1000}$ and $\eta_{3000}$ is more than 20 Pa*s.

The polyarylene sulfide, prior to spinning, is conventionally subjected to a drying process. For this purpose, the polymer, generally in a finely divided form, such as a powder form or granular form and in particular in the form of chips, is preferably dried under vacuum. Conventional drying times are between 6 and 10 hours. The drying temperature is conventionally 120° to 160° C., preferably 120° to 140° C. However, the drying can also be performed under inert gas.

A polyarylene sulfide is particularly preferably used whose water content is at most 0.01%, measured by the Karl-Fischer method. Using this raw material, particularly stable spinning conditions can be established.

In the process according to the invention, filament-forming polymers are melt-spun, the molten polymer being spun by means of an extruder and a spinning pump through a spinneret into a closed spinning shaft.

The minimum throughput of polymer through the spinneret is preferably 0.5 g/(min*hole). Particularly preferred throughputs are in the range from 0.7 to 1.3 g/(min*hole).

In the case of the preferred polyphenylene sulfide, the temperatures in the spinneret are conventionally 280° to 320° C., preferably 295° to 315° C.

Any type of spinneret can be used. Typical numbers of holes in a spinneret are in the range from 50 to 500, in particular from 100 to 500. The shape of the spinneret holes can likewise be selected as desired, for example triangular or rectangular, multilobal, oval or, in particular, round. Typical diameters of the spinneret holes are in the range from 0.25 to 0.65 mm.

The spinneret holes in a ring spinneret are preferably arranged in the form of concentric circles.

Spinning is carried out into a closed spinning shaft into a gas, in particular into air, or else into an inert gas, such as nitrogen.

The term "closed spinning shaft" in the context of this invention is taken to mean a spinning shaft in which the intake and offtake of the quench gas is principally, for example up to more than 90%, achieved via the feedline and discharge line for the quench gas and in which only a small part of the quench gas leaves the spinning shaft through the outlet orifice for the filaments formed.

This outlet orifice must therefore be configured in such a way that, in addition to the high rate of passage of the filaments formed, it also permits a good seal against an exit of the contaminated quench air in the interior of the spinning shaft.

The freshly spun filaments can thus, for example, be conducted outwards through a labyrinth seal or through perforated end plates, below or between which an additional auxiliary extractor removes the entrained quench gas by suction.

The spinning shaft can be operated at reduced pressure, external pressure or superatmospheric pressure. A slight reduced pressure is advantageously maintained in the spinning shaft, preferably a pressure reduced by between 20 and 150 Pa with respect to the surroundings. This variant, in the case of leaks or pressure variations, prevents an immediate flowing-out of the contaminated quench air into the surroundings.

The filaments produced, after the extrusion through the spinneret, are subjected to forced cooling in the spinning shaft by quenching with a gas. In this case, all quenching processes which are conventional per se can be used. In addition to the possible transverse quench, the central quench, in particular, is useful. Of these, in particular the quench from the inside to the outside is preferred. The gas used can be an inert gas, such as nitrogen. Air is preferred.

The spinning take-off velocity of the filaments on leaving the spinning shaft can be more than 500 m/min, preferably between 800 and 5000 m/min, and in particular 1000 to 2000 m/min.

Expediently, a conventional drawing preparation is applied to the filaments on leaving the spinning shaft. This can be carried out shortly before, during or shortly after leaving the spinning shaft. However, the preparation can alternatively be applied at other positions of the production plant. The application of the preparation can be carried out by all means known therefor, for example by spraying or by application with a preparation roll.

The quench gas loaded with sulfur-containing gases and/or vapors is fed from the spinning shaft via one or more discharge lines to a gas purification system. It has been shown that the used quench air must be purified by contact with an adsorbent for said troublesome gases and/or vapors.

Examples of suitable adsorbents are silica gel or, in particular, activated charcoal.

The adsorbents are preferably used in drum-like containers furnished with an intake and outlet and preferably with the required ventilator. Such gas purification systems are obtainable commercially in a modular structure.

After leaving the spinning shaft and, possibly, after application of the preparation, the spun filaments are further treated in a manner known per se. For this purpose, for example, they are subjected to application of a finishing, drawing which, if required, can also be multistage, and, if required, a fixing. The further processing can be performed continuously directly after the take-off from the spinning machine or after an intermediate storage of the freshly spun filaments.

At the end of the further processing stage, the filaments obtained are either wound up or chopped in a manner known per se to form staple fibers.

In FIG. 1, an example of an apparatus according to the invention is depicted.

The thermoplastic polymer to be spun is melted via an extruder (1) and transported to a spinning pump (2). The extruder is fed, for example, with polymer chips. The spinning pump (2) feeds the spin pack (3) which contains a filter (4) and spinnerets (5). The spinnerets (5) open out directly into a closed spinning shaft (6) which is provided with at least one feedline (7) and one discharge line (8) for the quench gas. In the representation of FIG. 1, two discharge lines (8) for the quench gas are depicted at the top and bottom end of the spinning shaft. In addition, in this FIG. 1, an auxiliary extraction line (12) for the quench gas is further provided, which is mounted at the bottom end of the spinning shaft next to the outlet orifice for the filaments. In the representation of FIG. 1, all discharge lines for the quench gas are equipped with a gas purification system (9). However, it is absolutely possible for all discharge lines to open out into one gas purification system. The purified quench air is withdrawn from the gas purification system via pumps (18).

In addition, in FIG. 1, a central quench apparatus (11) is depicted from which the quench gas (10) flows radially from the inside to the outside through the filaments formed. Such quench apparatuses can be formed from tubes whose casing is provided with boreholes or other openings such as slots or screens or which is preferably composed of sintered metal.

The central quench from inside to outside is particularly advantageous since with this embodiment, a particularly stable run of the filaments is made possible.

After leaving the spinning shaft through the outlet orifice (13), the filaments (14) receive an application of preparation by application rolls (15), are conducted via a reversing godet (16) and wound up on a bobbin (17). The spun filaments can finally be supplied to further processing.

To control the pressure within the spinning shaft, the quench gas is expediently blown in via a ventilator through the feedline (7) into the closed spinning shaft (6). At least one of the discharge lines (8) is equipped with a second ventilator, for example the extraction line at the bottom end of the spinning shaft in FIG. 1. In normal operation, the pressure in the interior of the spinning shaft can be regulated by the different output of the ventilators in the feedline and discharge line.

To operate the spinning plant, the spinning shaft must be opened when the plant is operating. For this purpose, the spinning shaft is preferably provided beneath the spinneret with an apparatus which permits the spinning shaft to be opened during operation of the plant. In order to prevent exit of contaminated quench gas, it is expedient if a second powerful extractor is mounted in the region of the shaft opening beneath the spinneret, preferably on both sides beneath the spinneret, which is turned on when the shaft doors are opened and which prevents the exit of contaminated quench gas into the space in front of the shaft when the doors are open.

We claim:

1. A process for producing fibers from polymers which give off troublesome gases and/or vapors during spinning, comprising the steps of:

a) extruding the molten polymer through a spinneret into a closed spinning shaft, b) quenching the resulting filaments in the spinning shaft with a gas, c) taking off the resulting filaments from the spinning shaft, d) conducting the quench gas away from the spinning shaft and introducing it into a gas purification system and e) purifying the used quench gas by contact with an adsorbent for said troublesome gases and/or vapors.

2. The process as claimed in claim 1, wherein polymers are spun which give off sulfur- and/or halogen-containing gases and/or vapors during spinning.

3. The process as claimed in claim 2, wherein the polymer is a polyarylene sulfide or a mixture of polyarylene sulfides or a mixture of polyarylene sulfide and other thermoplastic polymers.

4. The process as claimed in claim 3, wherein the polyarylene sulfide is p-polyphenylene sulfide or a mixture of p-polyphenylene sulfides.

5. The process as claimed in claim 3, wherein polyphenylene sulfides are used which have, at 320° C., a melt viscosity, measured at a shear rate of 1000 $sec^{-1}$ ($\eta 1000$), of 60 to 150 Pa*s and a melt viscosity, measured at a shear rate of 3000 $sec^{-1}$ ($\eta_{3000}$), of more than 50 Pa*s, the difference between $\eta_{1000}$ and $\eta_{3000}$ being more than 20 Pa*s.

6. The process as claimed in claim 3, wherein the polyarylene sulfide is dried in a finely divided form prior to spinning.

7. The process as claimed in claim 6, wherein the drying is performed under vacuum and the drying is carried out until a water content of the polymer of at most 0.01%, measured by the Karl-Fischer method, is achieved.

8. The process as claimed in claim 1, wherein the spinnerets have more than 100 spinneret holes.

9. The process as claimed in claim 1, wherein a reduced pressure is maintained in the spinning shaft with respect to the surroundings.

10. The process as claimed in claim 1, wherein a transport rate of the polymer through the spinneret of at least 0.5 g/(min*hole) is selected.

11. The process as claimed in claim 1, wherein the spun filaments are taken off from the spinning shaft at a velocity of more than 500 m/min.

12. The process as claimed in claim 1, wherein the quench gas flows radially onto the spun filaments.

13. The process as claimed in claim 1, wherein the adsorbent for said troublesome gases and/or vapors is activated charcoal.

14. The process as claimed in claim 8, wherein the spinnerets are arranged in concentric circles.

15. The process as claimed in claim 9, wherein the pressure in the spinning shaft is reduced by between 20 and 150 Ps with respect to the surroundings.

16. The process as claimed in claim 11, wherein the spun filaments are taken off from the spinning shaft at a velocity of from 800 to 3000 m/min.

17. The process as claimed in claim 12, wherein the quench gas flows from the inside to the outside.

* * * * *

UNITED STATES PATENT AND TRADEMARK OFFICE

CERTIFICATE OF CORRECTION

PATENT NO. : 5,370,833

DATED : December 6, 1994

INVENTOR(S) : Herbert Wellenhofer, et al

It is certified that error appears in the above-indentified patent and that said Letters Patent is hereby corrected as shown below:

Column 2, line 31, (in the formula) "t" should read -- r --.

Column 6, line 9, (claim 5, line 4) "($\eta$1000)" should read -- ($\eta_{1000}$) --.

Column 6, line 42, (claim 15, line 3) "Ps" should read -- Pa --.

Signed and Sealed this

Twenty-first Day of February, 1995

*Attest:*

*Attesting Officer*

BRUCE LEHMAN

*Commissioner of Patents and Trademarks*